US005500092A

United States Patent [19]

Schiel

[11] Patent Number: 5,500,092

[45] Date of Patent: Mar. 19, 1996

[54] PRESS UNIT OF A PAPER MACHINE FOR THE MANUFACTURE OF TISSUE PAPER

[75] Inventor: Christian Schiel, Heidenheim, Germany

[73] Assignee: J. M. Voith GmbH, Heidenheim, Germany

[21] Appl. No.: 248,034

[22] Filed: May 24, 1994

[30] Foreign Application Priority Data

May 29, 1993 [DE] Germany ..... 43 18 036.1

[51] Int. Cl.[6] ..... D21F 11/14; D21F 3/02; D21F 5/02

[52] U.S. Cl. ..... 162/358.3; 162/359.1; 162/360.3; 162/363; 162/368; 162/358.1

[58] Field of Search ..... 162/359.1, 358.1, 162/358.2, 358.3, 358.4, 358.5, 360.3, 360.2, 363, 368, 396, 206, 205; 100/153, 154, 144

[56] References Cited

U.S. PATENT DOCUMENTS

| | | | |
|---|---|---|---|
| 3,783,097 | 1/1974 | Justus | 162/358.3 |
| 4,075,056 | 2/1978 | Ely et al. | 162/305 |
| 4,144,124 | 3/1979 | Turunen et al. | 162/290 |
| 4,705,602 | 11/1987 | Dahl | 162/358.3 |
| 4,988,410 | 1/1991 | Meinecke et al. | 162/360.1 |
| 5,092,962 | 3/1992 | Koski | 162/358 |
| 5,120,400 | 6/1992 | Laapotti | 162/206 |
| 5,230,776 | 7/1993 | Anderson et al. | 162/290 |
| 5,308,450 | 5/1994 | Braun et al. | 162/360.2 |

FOREIGN PATENT DOCUMENTS

| | | | |
|---|---|---|---|
| 1068525 | 12/1979 | Canada | 92/21 |
| 4224730C1 | 7/1992 | Germany | D21F 11/14 |

OTHER PUBLICATIONS

Development of the Extended Nip Press by Justus, E. J. and Cronin, Dennis C., Tappi Engineering Conference, Sep. 30, 1981.

*Primary Examiner*—David L. Lacey
*Assistant Examiner*—Jose S. Fortuna
*Attorney, Agent, or Firm*—Baker & Daniels

[57] ABSTRACT

The invention is directed to a press system of a paper machine for making tissue, including a crepe drying cylinder, a press roll with a smooth surface, an extended-shoe press unit, and a press roll fashioned as a suction roll or grooved roll. A first press gap is formed by the press roll with a smooth surface and the press roll designed as a suction roll or grooved roll. A water collection tub is coordinated with the suction roll or grooved roll. A second gap is formed between the press roll with the smooth surface and the extended-shoe press unit after which the felt leaves the periphery of the press roll with the smooth surface. Following thereafter, a third press gap is provided between the press roll with the smooth surface and the crepe drying cylinder. The felt does not pass through the third press gap.

1 Claim, 1 Drawing Sheet

PRESS UNIT OF A PAPER MACHINE FOR THE MANUFACTURE OF TISSUE PAPER

BACKGROUND OF THE INVENTION

The invention concerns a press unit for the manufacture of tissue paper.

DE 42 24 730 A1 illustrates for the manufacture of a tissue web a paper machine which employs as press unit, at least partly, so-called extended shoe presses. The application of the extended shoe press aims to accomplish an improved drying capacity through the extended shoe presses. A disadvantage of the embodiments shown in DE '730 is constituted by an insufficient dewatering of the press felt.

The problem underlying the invention is to present such a press unit arrangement of a tissue paper machine which features a particularly high dewatering of the press felt in conjunction with an extended shoe press.

SUMMARY OF THE INVENTION

The present invention is directed to a press system arrangement including a first press gap defined by a press roll with a smooth surface and a press designed as a suction roll or a grooved roll; a water collection tub coordinated with the suction roll or grooved roll; a second press gap formed between the press roll having a smooth surface in the extended shoe press unit, after which the felt leaves the periphery of the press roll having the smooth surface; and a third press gap formed between the press roll having a smooth surface and a drying cylinder. The felt does not pass through the third press gap.

BRIEF DESCRIPTION OF THE DRAWINGS

The invention is more fully explained with the aid of the drawing, wherein.

DETAILED DESCRIPTION OF THE INVENTION

Figure 1:
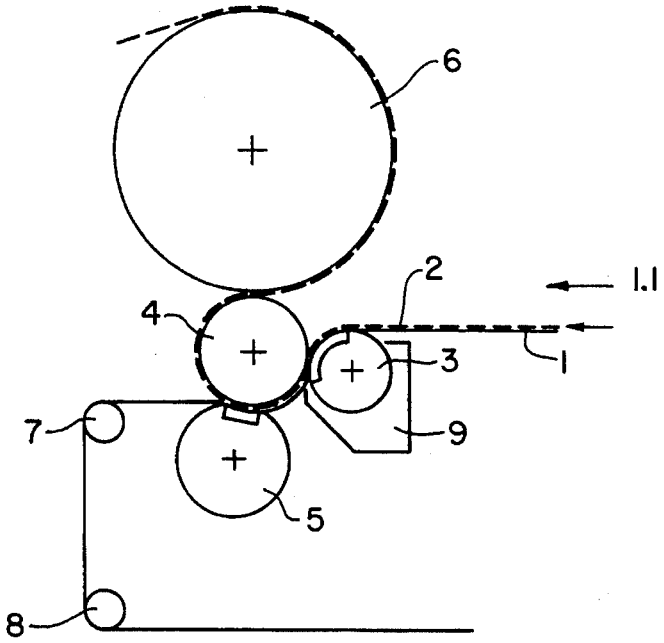
FIGS. 1 and 2 illustrate one embodiment of a press system according to the invention.

FIG. 1 shows an inventional press system of a paper machine for the manufacture of a tissue web with an extended shoe press. Illustrated in exemplary fashion and coming from the right is a felt 1 with direction of travel 1.1, which felt carries a paper web 2. By way of a press roll 3 fashioned as a suction roll or as a grooved roll the felt is introduced in a press gap between the press roll 3 and a smooth-surface press roll 4, the felt being rid of water through a suction zone before entering the press gap. Upon passage of the press gap between the rolls 3 and 4, the felt—continuing on the press roll 4—is together with the paper web introduced directly in a press gap of an extended shoe press including a shoe press roll 5 with stationary press shoe—around which extends an impermeable press belt or a press shell—and of the press roll 4 provided as backing roll. Following the press gap of the extended shoe press, the felt 1 returns via two or more reversing rolls 7 and 8 while the paper web 2 continues along on the press roll 4, proceeding directly into the next press gap between the drying cylinder 6 and press roll 4 in contact with it. Drying cylinder 6 may at the same time be fashioned as a crepe cylinder. After the press gap, the paper web clings inventionally to drying cylinder 6 until web removal. The water removed by the roll 3 from the felt 1 is dumped in collection chute 9. Press roll 3 may inventionally be designed as a suction roll or as a grooved roll, and press roll 4 with the smooth surface may be a rigid roll or one with flexure compensation.

Figure 2:
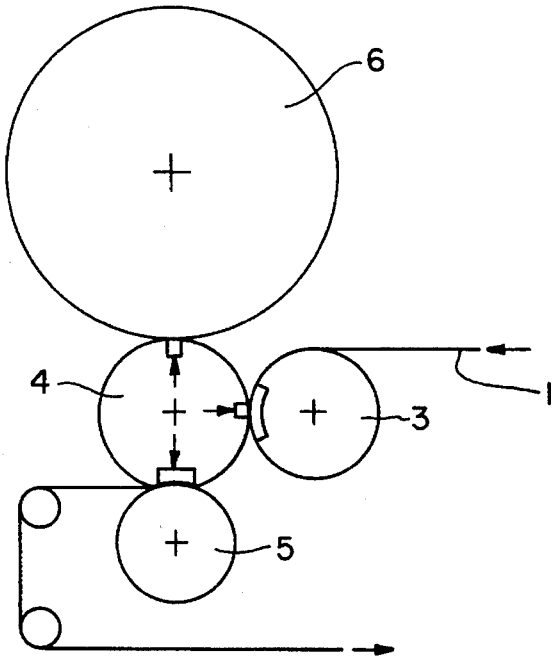

FIG. 2 shows a press arrangement similar to FIG. 1, but the press roll 4 is fashioned with an elastic surrounding shell and possesses opposite the suction roll 3 and drying cylinder 6 an outward-curving contact surface, whereas press roll 5 is fashioned as a backing roll which is opposed by a conventional extended press shoe.

I claim:

1. A press system for a paper machine used in the production of a fiber web, comprising:

a crepe drying cylinder a first press roll having a smooth surface;

an extended shoe press unit;

a second press roll configured as one of a suction roll or a grooved roll;

a felt adapted to run together with the fiber web, said felt disposed adjacent to at least a portion of a periphery of said first press roll, said extended shoe press and said second press roll to receive water therefrom; and a water collection tub operatively associated with said second press roll;

said first press roll and said second press roll defining a first press gap therebetween;

said first press roll and said extended shoe press defining a second press gap therebetween;

said first press roll and said crepe drying cylinder defining a third press gap therebetween;

said felt extending through said first and second press gaps but not extending through said third press gap.

* * * * *

UNITED STATES PATENT AND TRADEMARK OFFICE

CERTIFICATE OF CORRECTION

PATENT NO. : 5,500,092

DATED : March 19, 1996

INVENTOR(S) : Christian Schiel

It is certified that error appears in the above-indentified patent and that said Letters Patent is hereby corrected as shown below:

Claim 1, column 2, line 38, after "roll" delete "to receive water therefrom".

Claim 1, column 2, line 40, after "roll" insert --to receive water therefrom--.

Signed and Sealed this

Second Day of July, 1996

Bruce Lehman

*Attest:*

BRUCE LEHMAN

*Attesting Officer*

*Commissioner of Patents and Trademarks*